US006322392B1

(12) United States Patent
Wang

(10) Patent No.: US 6,322,392 B1
(45) Date of Patent: Nov. 27, 2001

(54) GROUND PLATE STRUCTURE FOR A PC CARD CONNECTOR ASSEMBLY

(75) Inventor: Hwa Li Wang, Taipei (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/291,123

(22) Filed: Apr. 14, 1999

(30) Foreign Application Priority Data

Apr. 24, 1998 (TW) ..... 87206371

(51) Int. Cl.[7] ..... H01R 4/66; H01R 13/648
(52) U.S. Cl. ..... 439/607; 439/101; 439/108
(58) Field of Search ..... 439/101, 108, 439/79, 80, 541.5, 607, 608, 609, 83, 610

(56) References Cited

U.S. PATENT DOCUMENTS 5,288,247 2/1994 Kaufman ..... 439/607
5,478,260 12/1995 Kaufman et al. ..... 439/609
5,688,130 11/1997 Huang ..... 439/79
5,795,190 8/1998 Ono ..... 439/607
5,807,137 * 9/1998 Janota et al. ..... 439/607
5,934,941 * 8/1999 Hirai et al. ..... 439/607

* cited by examiner

*Primary Examiner*—Tulsidas Patel
*Assistant Examiner*—Chandrika Prosad
(74) *Attorney, Agent, or Firm*—Stacey E. Caldwell

(57) ABSTRACT

A surface mount ground plate structure for a PC card connector assembly is provided such that the solder joints of the ground plate, as well as the signal terminals of the underlying connector can be inspected, thus facilitating the assembly of the PC card connector assembly to an underlying printed circuit board. The ground plate is mounted to the connector in the same direction that the connector is mounted to the circuit board. The ground plate comprises a main body, a plurality of mating ground pins extending from one side of the main body, and two ground solder tails arranged on opposite sides of the main body adapted to be surface mount connected to the printed circuit board.

4 Claims, 5 Drawing Sheets

GROUND PLATE STRUCTURE FOR A PC CARD CONNECTOR ASSEMBLY

FIELD OF INVENTION

The present invention relates to a PC card connector assembly, and, more particularly, to a simple ground plate structure for a PC card connector assembly that facilitates the assembly of a PC card connector assembly to an underlying printed circuit board.

BACKGROUND OF THE INVENTION

Conventional PC card connector assemblies, such as those that receive PCMCIA (Personal Computer Memory Card Interface Association)-style cards, are illustrated in FIGS. 1 and 2 include a connector (C) with signal terminals (1B) adapted for connecting signal contacts of the card to corresponding signal traces of an underlying circuit board (B) and a separate ground plate including ground terminals (1A) for contacting corresponding ground contacts on the card and a plurality of ground solder tails (1C) adapted to be soldered to ground traces of the underlying circuit board to common the ground plate to the ground of the circuit board.

However, many of the grounding plates of prior art PC card connector assemblies are difficult to manufacture and complicated to assemble. Furthermore, many of the ground plates of the prior art include shield portions which extend over portions of the signal terminals of the connector, which makes inspection of the solder joints of the signal contacts to the underlying circuit board difficult, if not impossible. This configuration can also cause open circuit and short circuit conditions, which is undesirable. Still further, in some prior art ground plates, the location of the connection to the printed circuit board is made underneath a portion of the connector and thus visual inspection of the ground terminal solder joint is difficult. Also, many of the ground plates of the prior art include solder tails which extend through the thickness of the circuit board and interfere with component placement on an underside of the board, thus using up valuable surface area of the circuit board and preventing maximum density of components within an electronic apparatus. Finally, many of the prior art ground plates are assembled to their underlying connector in a sliding or horizontal direction and therefore cannot be adapted to automated assembly, which assembles components only in a vertical direction.

SUMMARY OF THE INVENTION

It is the object of the present invention to provide a simple ground plate structure for a PC card connector assembly which solves the problems set forth above. That is, the structure of the ground plate in the subject invention is easy to manufacture and assemble to the underlying connector. Furthermore, the ground plate extends across the top of the connector and does not include a portion which extends over the solder tails of the signal terminals, thus allowing for visual inspection of the solder joints of the signal terminals and preventing the occurrence of short circuit conditions. The solder connection between the ground plate and the circuit board is true surface mount, that is, it does not extend through the circuit board, and the location of the connection is outside of the area occupied by the connector, thereby allowing visual inspection of the solder joint between the ground plate and the circuit board. Finally, the ground plate is assembled to the connector and circuit board in a vertical direction, not requiring horizontal assembly or interengagement with the connector, thus facilitating automated assembly of the connector assembly.

The ground plate of the invention comprises a main body, a plurality of mating ground pins extending away from one side of the main body including portions formed thereon for securing the ground plate to the connector, and ground solder tails extending from the opposite ends of the main body for solder connection to the underlying printed circuit board.

Other objects, features and advantages of the invention will be apparent from the following detailed description taken in conjunction with the appended drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 3:
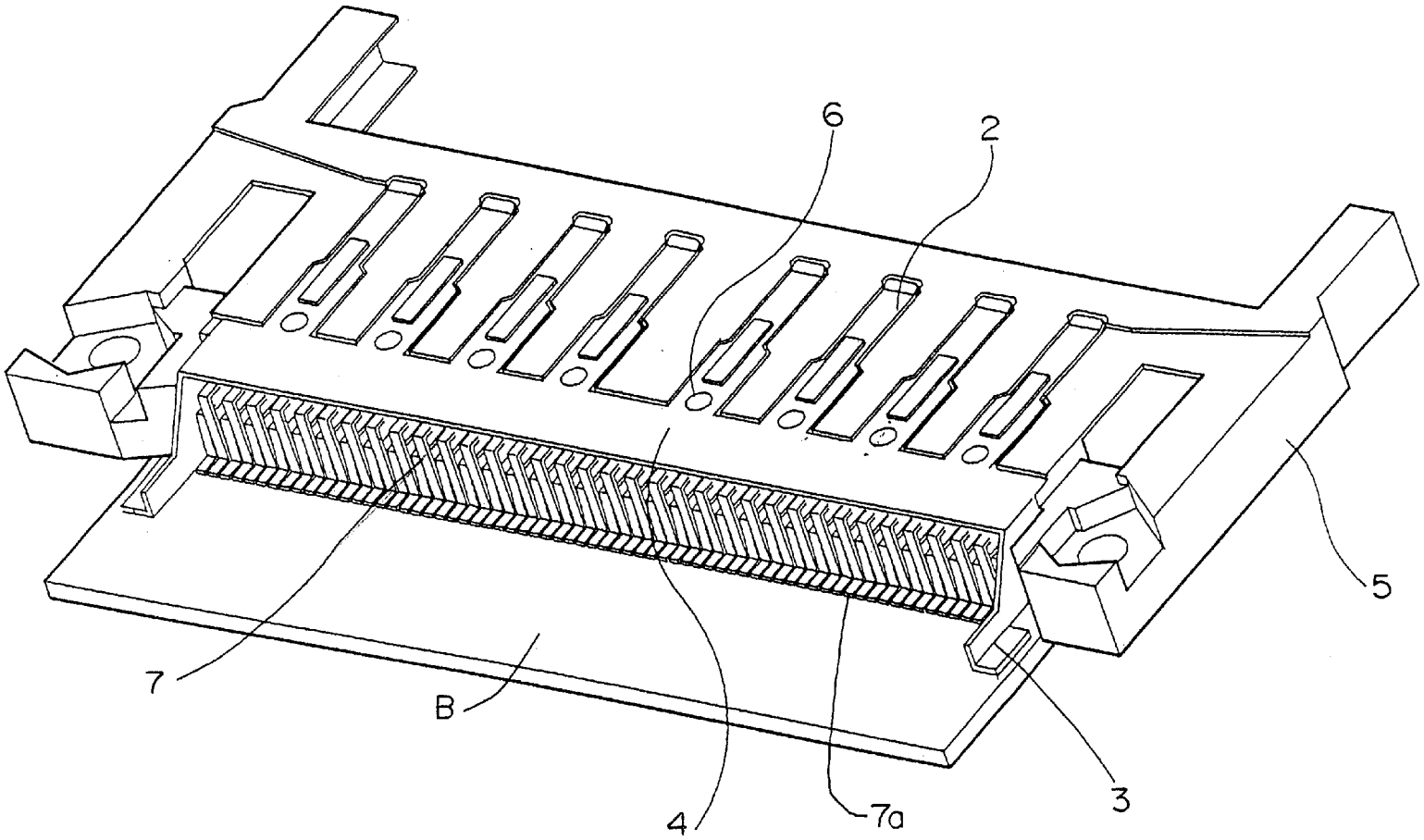
FIG. 3 is a perspective view of the PC card connector assembly of the invention, in its assembled state.
Figure 4:
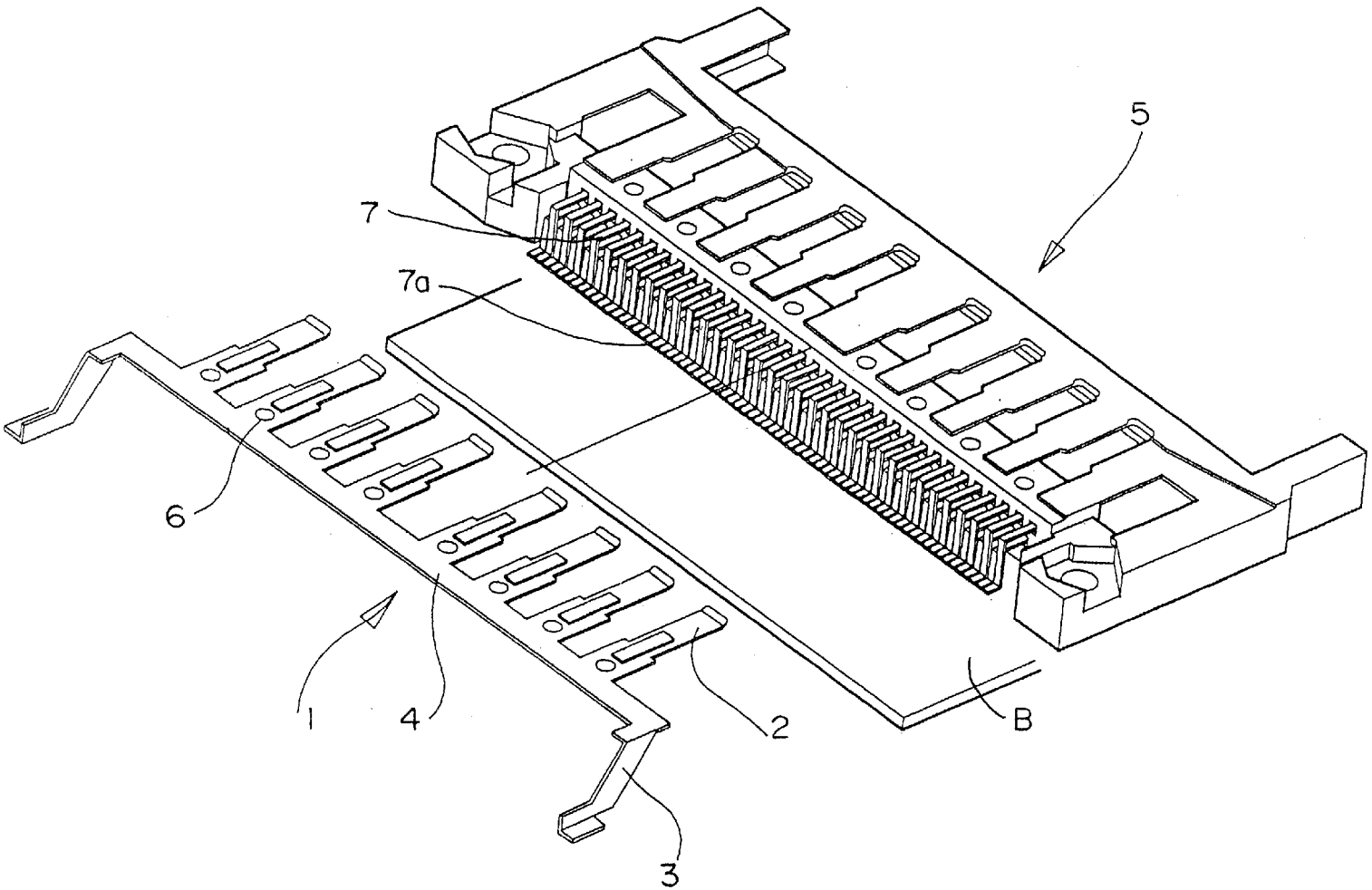
FIG. 4 is an exploded perspective view of the PC card connector assembly of the invention showing the ground plate removed from the connector.
Figure 5:
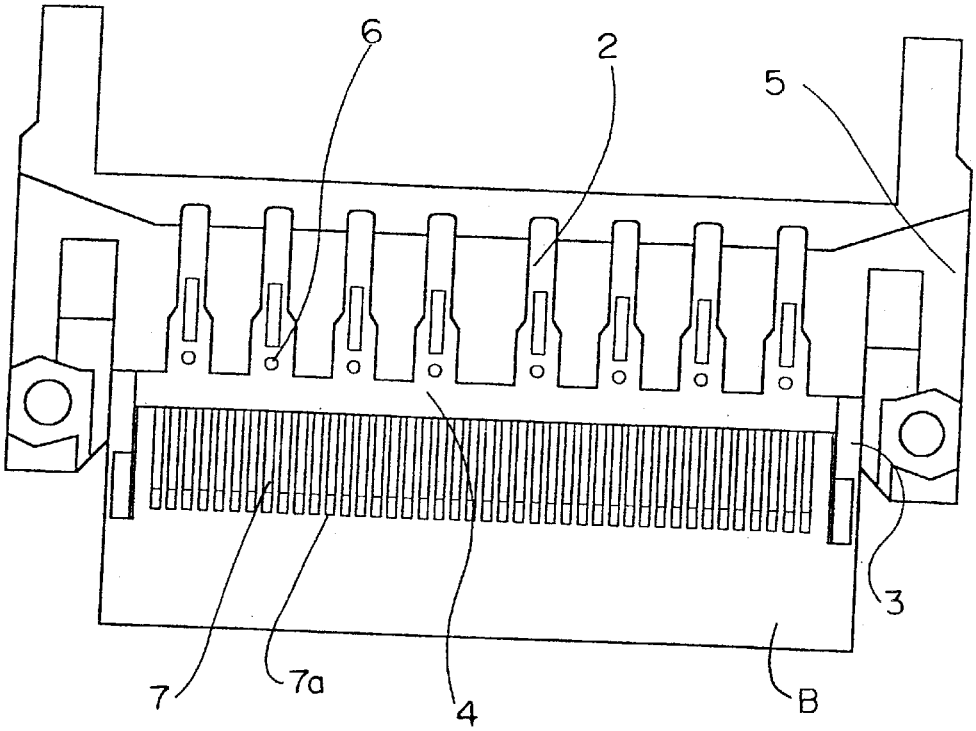
FIG. 5 is a top plan view of the PC card connector assembly of FIG. 3.

With reference to FIGS. 3 through 5, the present invention is directed to a simple ground plate structure for a PC card connector assembly which is surface connected to an underlying circuit board by way of surface mount ground solder tails at opposite ends of the ground plate. The ground plate 1 includes a main body 4 adapted to be mounted to an underlying connector 5. A plurality of mating ground pins 2 extend away from the main body generally in the same plane with the body and are adapted to mate with corresponding ground contacts on a mating card such as a PCMCIA card (not shown). A plurality of through holes 6 are formed on a portion of the main body 4 and cooperate with a portion of connector 5 to secure the ground plate structure thereto.

Figure 1:
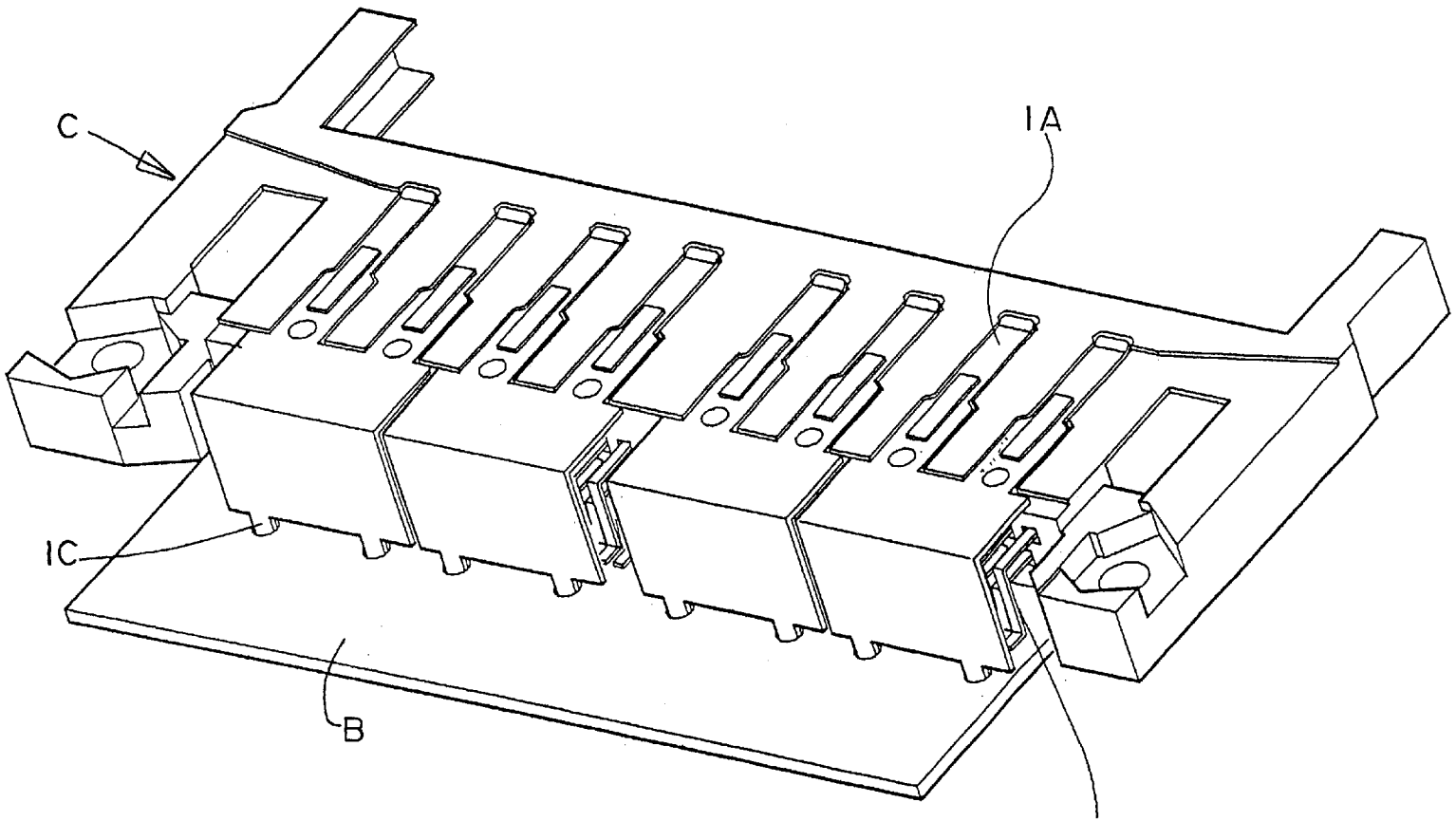
PRIOR ART FIG. 1
FIG. 1 is a perspective view of a conventional PC card connector assembly with a ground plate assembled to a connector and fixed within holes of a printed circuit board.
Figure 2:
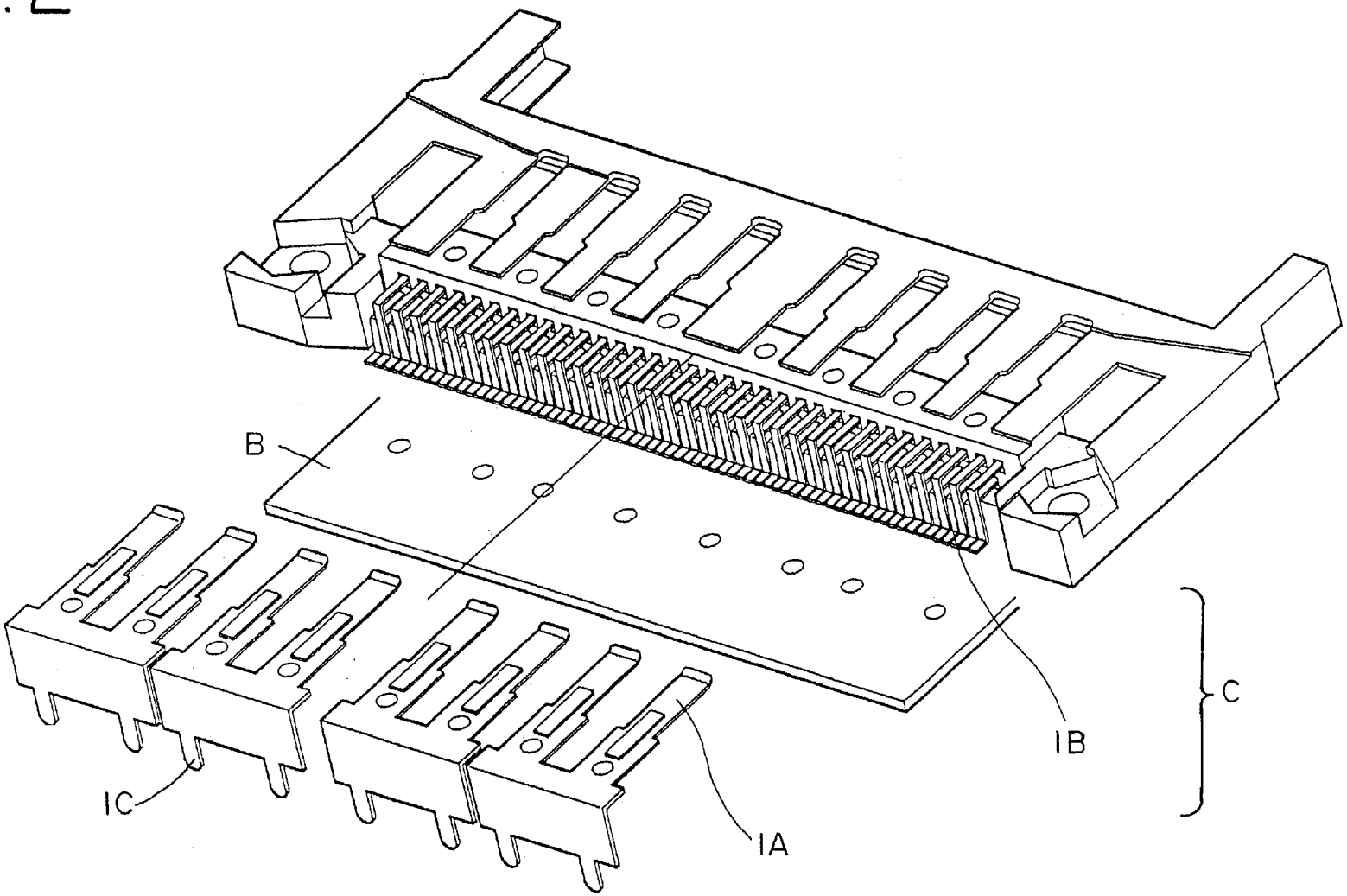
FIG. 2 is an exploded perspective view of the conventional PC card connector assembly of FIG. 1 showing the ground plate removed from the connector.

The two ground solder tails 3 extend from the opposite ends of main body 4 in a direction opposite from the mating ground pins and are adapted to be surface connected to corresponding ground traces of an underlying printed circuit board B in order to common the ground of the card to the ground circuit of the printed circuit board. The connection of the ground plate structure to the underlying circuit board at the ends of main body 4 allow the ground plate structure to remain open in the area of the signal pins 7 unlike the ground plate structure of the prior art (FIGS. 1 and 2), thus facilitating the assembly of the PC card connector assembly by allowing visual inspection of the solder joints of solder tails 7*a* the signal terminals of connector 5, and minimizing the chance of short circuiting between the ground plate and the signal terminals.

Furthermore, the location of the connection of the ground solder tail 3 to the underlying circuit board optimizes the visual inspection of the solder joint of the ground solder tail yet allows dense packaging of the circuit board with components and/or other connectors and allows automated assembly of the connector assembly to the circuit board. That is, the ground solder tail 3 connection to the circuit board is true surface mount, that is, it does not extend through the plane of the circuit board, thus allowing placement of densely packed electronic components anywhere on the opposite surface of the circuit board, unlike the ground solder tails (1C) of the prior art shown in FIGS. 1 and 2. Since the location of the connection of the ground solder tail 3 to the circuit board lies within the boundaries of the PC card connector assembly dimensions, components can be densely placed on the same side of the circuit board as well. Furthermore, the solder joint of ground solder tail 3 can be visually inspected after the PC card connector assembly is fixed to the circuit board.

Finally, the surface mount characteristic of the ground plate structure, along with the fact that it does not require horizontal interengagement or assembly with the connector 5, allows for automated assembly between the ground plate and the connector. That is, the connector 5 can be mounted onto the circuit board in a vertical direction, and the ground plate is mounted onto the connector 5 in the same direction, there is no mounting or assembling of the ground plate in a direction different from the connector-to-circuit board mounting direction.

Although the present invention has been described with reference to the preferred embodiment thereof, it will be understood that the invention is not limited to the details thereof. Various substitutions and modifications will occur to those of ordinary skill in the art and therefore all such substitutions and modifications are intended to be embraced within the scope of the invention as defined in the appended claims.

I claim:

1. In a PC card connector assembly for connecting a card member to the surface of an underlying printed circuit board, the connector assembly comprising a connector including signal terminals mounted therein, the signal terminals terminating in a single row of signal solder tails for surface connection to corresponding signal traces of the printed circuit board, and an elongated ground plate mounted on the connector including a generally planar main body, a plurality of generally parallel mating ground pins unitary with and extending forwardly from one side of the main body, and a surface mount ground solder tail on each distal end of the main body extending rearwardly and downwardly at an angle from said main body laterally of the signal solder tails for direct surface connection to corresponding ground traces of the printed circuit board rearward of the signal solder tails, wherein when the PC card connector assembly is soldered to the underlying circuit board, solder joints between the signal solder tails and the circuit board are not visually obstructed by the solder joints between the ground solder tails and the circuit board, and the solder joints between the ground solder tails and the circuit board are not visually obstructed by the connector.

2. In the PC card connector assembly of claim 1 wherein the main body of the ground plate further comprises securing means adjacent each mating ground pin which cooperate with portions of the connector to secure the ground plate to said connector.

3. In the PC card connector assembly of claim 2 wherein the securing means are in the form of holes formed on the main body.

4. In the PC card connector assembly of claim 1 wherein the connector is mounted to the underlying circuit board in a first direction, and the ground plate is also mounted to the connector in the first direction only.

* * * * *